US006226483B1

(12) United States Patent
Kazakos et al.

(10) Patent No.: US 6,226,483 B1
(45) Date of Patent: May 1, 2001

(54) CHARGING ROLLER AND PROCESSES THEREOF

(75) Inventors: Ann M. Kazakos; Joy L. Longhenry, both of Webster; Michelle L. Schlafer, Fairport; Michael J. Duggan, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/364,297

(22) Filed: Jul. 30, 1999

(51) Int. Cl.[7] ..... G03G 15/08
(52) U.S. Cl. ..... 399/266; 399/279; 399/291
(58) Field of Search ..... 399/266, 279, 399/284, 285, 290, 291, 265, 252, 354, 353; 492/18, 28

(56) References Cited

U.S. PATENT DOCUMENTS

| | | | | |
|---|---|---|---|---|
| 5,322,970 | * | 6/1994 | Behe et al. | 399/279 |
| 5,473,418 | * | 12/1995 | Kazakos et al. | 399/284 |
| 5,600,414 | | 2/1997 | Hyllberg | 399/176 |
| 5,609,553 | | 3/1997 | Hyllberg | 492/53 |
| 5,701,572 | * | 12/1997 | Behe et al. | 399/354 |
| 5,707,326 | | 1/1998 | Hyllberg | 492/53 |
| 5,869,808 | | 2/1999 | Hyllberg | 219/216 |

* cited by examiner

*Primary Examiner*—Arthur T. Grimley
*Assistant Examiner*—Hoan Tran
(74) *Attorney, Agent, or Firm*—John L. Haack

(57) ABSTRACT

An article including a cylindrical roller core; and a titanium dioxide ceramic layer bonded to the exterior of the cylindrical core.

22 Claims, 4 Drawing Sheets

CHARGING ROLLER AND PROCESSES THEREOF

REFERENCE TO COPENDING APPLICATIONS AND ISSUED PATENTS

Attention is directed to commonly owned and assigned U.S. Pat. No. 5,322,970, issued Jun. 21, 1994, to Behe, et al., wherein there is disclosed a donor roll for the conveyance of toner in a development system for an electrophotographic printer that includes an outer ceramic surface. The ceramic has a suitable conductivity to facilitate a discharge time constant thereon of less than 600 microseconds. The donor roll is used in conjunction with an electrode structure as used in scavengeless development.

The disclosure of the above mentioned patent application is incorporated herein by reference in its entirety. The appropriate components and processes of the patent may be selected for the roller articles, preparative and developmental processes of the present invention in embodiments thereof.

BACKGROUND OF THE INVENTION

The present invention relates to a developer apparatus for electrophotographic printing. More specifically, the invention relates to a donor roll, for example, as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced. The toner image may then be transferred to a substrate or support member, such as paper, and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways. In the process of electrophotographic printing, the step of conveying toner to the latent image on the photoreceptor is known as development. The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a developer roll. The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge, to enable the particles to adhere to the photoreceptor, and magnetic properties, to allow the particles to be magnetically conveyed to the photoreceptor. Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor. An important variation to the general principle of development is the concept of "scavengeless" development. The purpose and function of scavengeless development are described more fully in, for example, U.S. Pat. No. 4,868,600 to Hays et al.; U.S. Pat. No. 4,984,019 to Folkins; U.S. Pat. No. 5,010,367 to Hays; or U.S. Pat. No. 5,063,875 to Folkins et al. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image-on-image" color xerography. A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, that is the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon. Another variation on scavengeless development uses a single-component developer material. In a single component scavengeless development, the donor roll and the electrode structure create a toner powder cloud in the same manner as the above-described scavengeless development, but instead of using carrier and toner, only toner is used. In any type of scavengeless development apparatus, one of the most important elements is the donor roll which conveys toner particles to the wires forming the electrode structure in the nip between the donor roll and the photoreceptor. Broadly speaking, a donor roll can be defined as any roll having only toner particles adhering to the surface thereof. To function commercially in scavengeless development, a donor roll should meet certain requirements. In general, a donor roll should include a conductive core and define a partially conductive surface, so that the toner particles may adhere electrostatically to the surface in a reasonably controllable fashion. In hybrid scavengeless development, the donor roll provides an electrostatic intermediate between the photoreceptor and the transport roll. The provision of this intermediate and the scavengeless nip minimizes unwanted interactions between the development system and the photoreceptor, in particular with a pre-developed latent image already on the photoreceptor, before the latent image in question is developed. Minimized interactions make scavengeless development preferable when a single photoreceptor is developed several times in a single process, as in color or highlight color xerography. The donor roll must further have desirable wear properties so the surface thereof will not be readily abraded by adjacent surfaces within the apparatus, such as the magnetic brush of a transport roll. Further, the surface of the donor roll should be without anomalies such as pin holes, which holes may be created in the course of the manufacturing process for the donor roll. The reason that such small surface imperfections must be avoided is that any such imperfections, whether pinholes created in the manufacturing process or abrasions made in the course of use, can result in electrostatic "hot spots" caused by arcing in the vicinity of such structural imperfections. Ultimately, the most important requirement of the donor roll can be summarized by the phrase "uniform conductivity;" the surface of the donor roll must be partially conductive relative to a more conductive core, and this partial conductivity on the surface should be uniform through the entire circumferential surface area. Other physical properties of the donor roll, such as the mechanical adhesion of toner particles are also important, but are generally not as quantifiable in designing a development apparatus. In addition, the range of conductivity for the service of a donor roll should be well chosen to maximize the efficiency of a donor roll in view of any number of designed parameters, such as energy consumption, mechanical control and the discharge time-constant of the surface.

PRIOR ART

In U.S. Pat. No. 5,869,808, issued Feb. 9, 1999, to Hyllberg, there is disclosed a thermal conductive roller for use in copying machines, steam-heated and induction-heated applications includes a ceramic heating layer formed by plasma spraying a ceramic material to form an electrically conductive heating layer of preselected and controlled resistance. Several methods of controlling the resistance of the ceramic heating layer are disclosed. The ceramic heating layer is sealed with a solid, low viscosity sealer such as carnuba wax to protect the ceramic layer from moisture penetration. Electrical current is applied at or near the core and is conducted radially outward through the heating layer to an outer grounded metallic layer. An outer contact layer of metal, ceramic, or polymeric material can be added.

In U.S. Pat. No. 5,609,553, issued Mar. 11, 1997, to Hyllberg, there is disclosed an electrostatic assist roller (30) for use in a coating, printing or copying machine includes a cylindrical roller core (35), and a ceramic layer (38) formed by plasma spraying a blend of an insulating ceramic material and a semiconductive ceramic material in a ratio which is selected to control the resistance and thickness of the ceramic layer in response to an applied voltage differential. The semiconductive ceramic layer (38) is sealed with a solid, low viscosity sealer (39), such as carnuba wax, to protect the ceramic layer (38) from moisture penetration. A second ceramic layer (37) may be used to insulate the semiconductive ceramic layer (38) from the core (35).

In U.S. Pat. No. 5,600,414, issued Feb. 4, 1997, to Hyllberg, there is disclosed a charging roller for use in a xerographic copying machine that includes a cylindrical roller core, and a ceramic layer formed by plasma spraying a blend of an insulating ceramic material and a semiconductive ceramic material in a ratio which is selected to control an RC circuit time constant of the ceramic layer in response to an applied voltage differential. The ceramic layer is sealed with a solid, low viscosity sealer, such as carnuba wax, to protect the ceramic layer from moisture penetration.

In U.S. Pat. No. 5,707,326, issued Jan. 13, 1998, to Hyllberg, there is disclosed a charging roller for use in a xerographic copying machine that includes a cylindrical roller core, and a ceramic layer formed by plasma spraying a blend of an insulating ceramic material and a semiconductive ceramic material in a ratio which is selected to control an RC circuit time constant of the ceramic layer in response to an applied voltage differential. The ceramic layer is sealed with a solid, low viscosity sealer, such as carnuba wax, to protect the ceramic layer from moisture penetration.

In the prior art, there are instances in which the physical properties of ceramics are exploited for various purposes relating to development of electrostatic latent images. U.S. Pat. No. 4,544,828 discloses a heating device utilizing ceramic particles as a heat source and adapted for use as a fixing apparatus. U.S. Pat. No. 4,893,151 discloses a single component image developing apparatus including a developing roller coated with a Chemical Vapor Deposition ceramic and an elastic blade coated with a ceramic. U.S. Pat. No. 5,043,768 discloses a rotating release liquid applying device for a fuser including an outer porous ceramic material.

The aforementioned patents are incorporated by reference herein in their entirety.

There remains a need for donor and charging rollers which are economical and efficient to make and use with, for example, acceptable and stable resistivity and conductivity properties, charging properties, and imaging processes thereof.

The rollers, the preparative processes, and imaging processes thereof of the present invention are useful in many applications and include imaging and printing processes, including color printing, for example, electrostatographic, such as in xerographic printers and copiers, including digital systems.

SUMMARY OF THE INVENTION

Embodiments of the present invention, include:

An article comprising:

a cylindrical roller core; and a titanium dioxide ceramic layer bonded to the exterior of the roller core; and a process for preparing the aforementioned article comprising:

coating a cylindrical roller core with a plasma spray coating of titanium dioxide;

grinding the coated surface to a smooth finish; and oxidative heating of the resulting coated roller; and a printing machine including the aforementioned titanium dioxide coated roller article for donation of toner particles in electrostatic latent image development.

These and other embodiments are illustrated herein.

DETAILED DESCRIPTION OF THE INVENTION

The present invention provides, in embodiments:

An article comprising:

a cylindrical roller core; and a titanium dioxide ceramic layer bonded to the cylindrical roller core.

Figure 1:
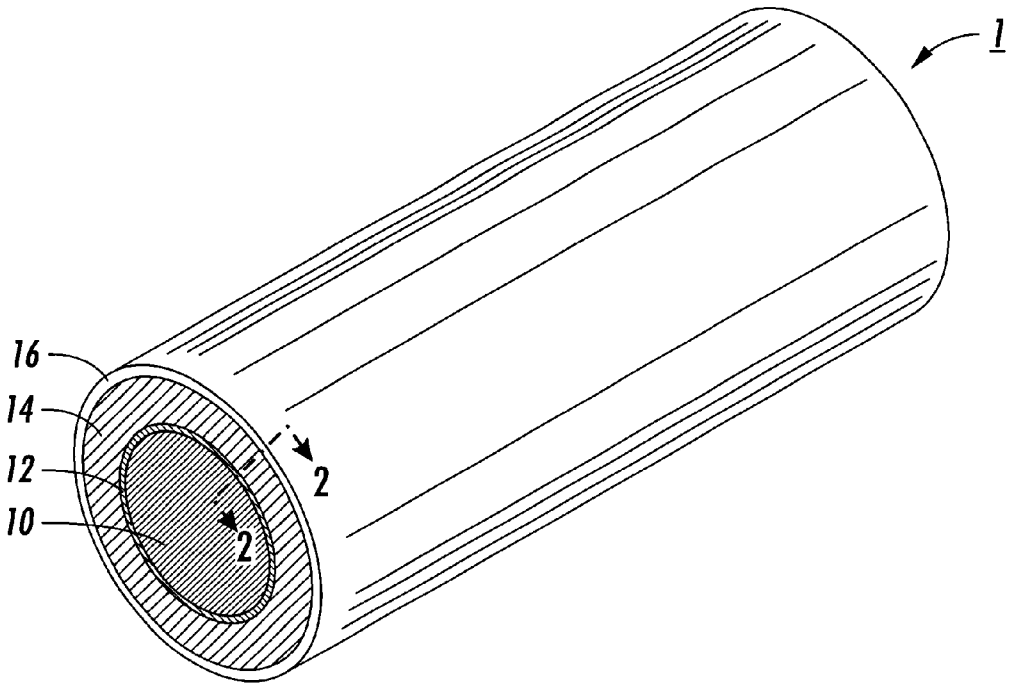
FIG. 1 shows a perspective view of an exemplary roll of the present invention.

Referring to the Figures, FIG. 1 is a perspective view an exemplary roll of the present invention and shows a roll (1) with a roller core(10), such as an electrically conductive material, an optional bond coat or mid-coat (12), a ceramic layer (14) bonded to the core consisting of a single component titanium material, and an optional top coat (16).

Figure 2:
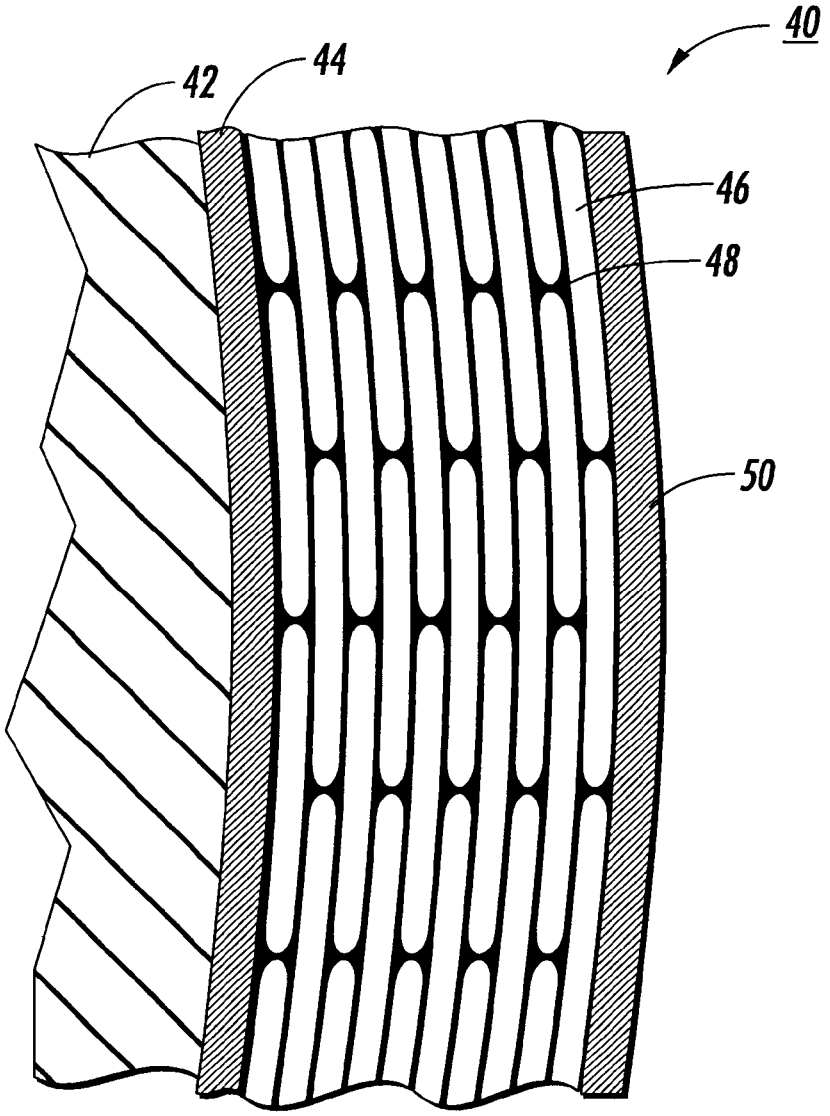
FIG. 2 is a magnified cross-section view of the donor roll of FIG. 1.

FIG. 2 provides a magnified cross-section view of the donor roll of FIG. 1 and shows the topmost coating layers near the outer surface of the roll(40) including the roller core (42), an optional mid-coat or bond coat (44), the mixed titanium ceramic layer (46), showing interstitial titanium oxide (48), and an optional surface coat (50).

Figure 3:
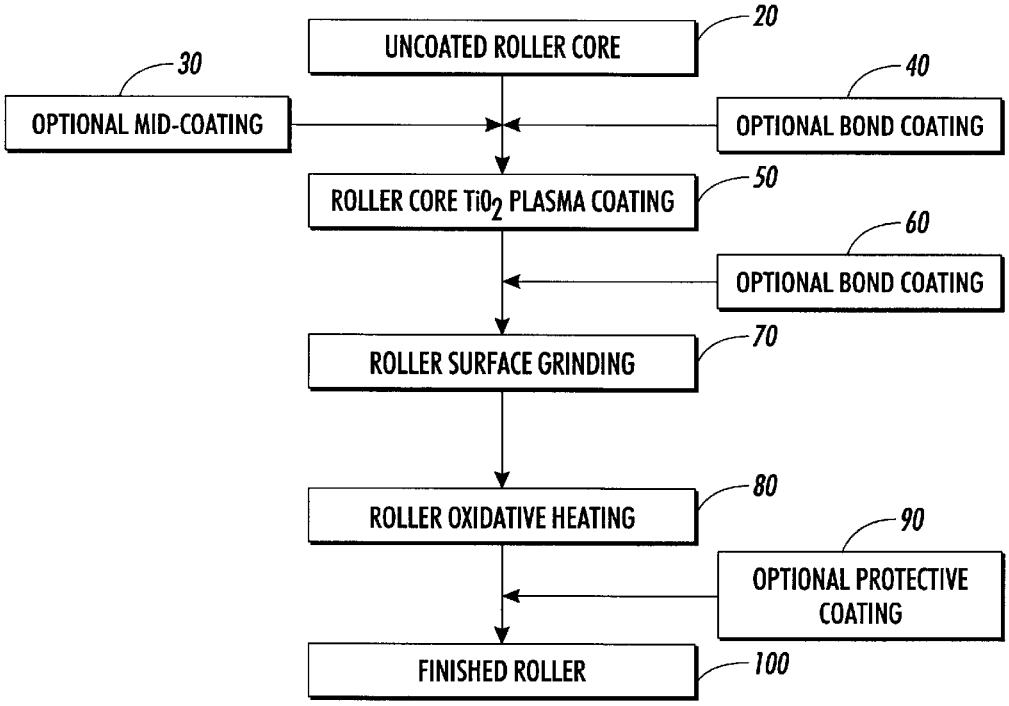
FIG. 3 is a flow diagram illustrating embodiments of the preparative process for the donor roll of the present invention.

FIG. 3 is a flow diagram illustrating embodiments of the preparative process for preparing the coated roller article of the present invention and shows schematically the process steps of treating an uncoated roller core (20), with optional mid-coat (30) or bond coat (40), followed by titanium plasma coating (50), and an optional post-plasma coating bond coat (60), then surface grinding (70) of the coated roller, and oxidative heating (80) of the ground roller, and an optional protective or surface coating (90), to produce the finished roller (100).

Figure 4:
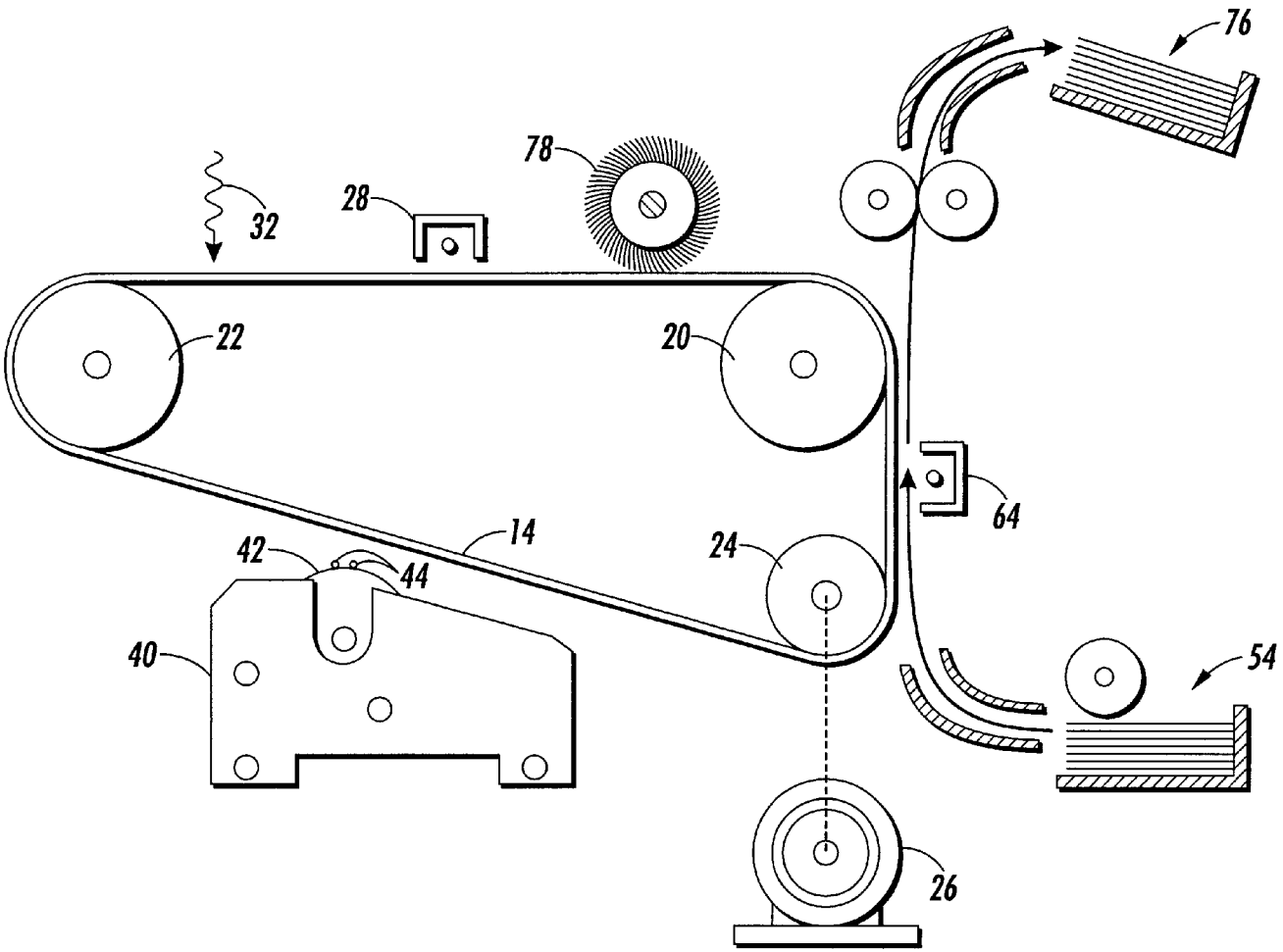
FIG. 4 is a schematic of an exemplary printing machine employing the donor roll of the present invention.

FIG. 4 shows partial aspects of an exemplary printing machine employing the donor roll (42) of the present invention as disclosed in the aforementioned commonly owned U.S. Pat. No. 5,322,970, to Behe, reference FIG. 3 therein and the corresponding text in the specification such as col. 5, line 44 to col. 8, line 28, the disclosure of which is again incorporated by reference herein in its entirety, and includes known componentry such as an image receiver or photoreceptor member (14), supported by rollers (20, 22, 24) and driven by motor (26), a charger (28), an original image exposure source (32), a developer housing (40) containing the novel single component donor roller (42) and electrode wires (44), wherein printed image receiver members such as sheets (54) receive a developed latent image by transfer of the image from the photoreceptor member (14) optionally assisted by charger (64) to produced printed image receiver sheets (76).

The ceramic layer is preferably bonded to the exterior or outside surface of the cylindrical roller core. The titanium dioxide ceramic layer can be formed, for example, by known reductive plasma spray coating of titanium dioxide followed by controlled oxidative heating of the reduced titanium oxide intermediate coated roller to form a titanium dioxide ceramic layer coated roller. Plasma spray coating technology is known and described in, for example, "Plasma-spray Coating", *Scientific American*, September 1988, pp. 112–117. The resulting coated article is electrostatically chargeable, that is, the roller is conductive and the coating layer is semi-conductive or semi-insulating and is capable of holding a charge for period of time without dissipation or leakage. The preparative process can further comprise optionally applying a bond coat to the uncoated roller core, and optionally a mid-coat to the uncoated roller core or the bond coated roller core. An exemplary mid-coat is a 1:1 by volume mixture of chrome aluminum yttrium cobalt powder and titanium dioxide commercially available from Sulzer Metco as 102. The bond coat provides enhanced adhesion of the ceramic layer coating to the roller. The intermediate or mid-coat functions to further enhance the coated roller's tolerance to the effects of the thermal expansion, that is, resistance to the potential for ceramic coating layer cracking or defects arising from the high temperature employed in the plasma-heating coating process. The thickness of the bond coat can be from 25 microns to 75 microns, for example, about 40 microns for each bond coat layer. One or more bond coats can be applied to the roller however thicker bond coats or multiple bond coats apparently do not provide greater adhesion than a single bond coat of from 25 microns to 75 microns. Thinner bond coats, such as less than about 25 microns, may not provide sufficient total roller surface coverage to provide the desired adhesion properties.

The preparative process can further comprise applying an optional protective overcoat to the surface of the ceramic coated roller, such as, waxes, polymeric resins, metal oxides or mixed metal oxides, hydrophobic metal oxides or mixed hydrophobic metal oxides, and the like materials, and mixtures thereof. The protective overcoat prevents or can compensate for, for example, wear and moisture penetration, and can be used to further adjust or fine tune the physical properties and performance characteristics of the roller surface, such as conductivity, surface tension, friction, and the like surface aspects. Protective sealer or overcoating layers include, for example, carnuba wax, or preferably a more durable and thermally robust substances such as the aforementioned hydrophobic metal oxides, such as titanates, silicates, silanes, and the like compounds, and mixtures thereof, and which overcoating layers can be applied during the latter stages of the oxidative heating stage, or alternatively after the roller has been cooled down and after optional machining of the ceramic surface layer is completed.

In embodiments, the resistivity of the coated roller article can be, for example, from about $10^{-3}$ to about $10^{10}$ ohm-cm, and preferably the resistivity is from about $10^{7}$ to about $10^{10}$ ohm-cm. The thickness of the titanium dioxide ceramic layer can be from about 75 to about 450 micrometers, and preferably from about 100 to about 400 micrometers. An advantage of the present invention over the aforementioned prior art ceramic coating processes and their resultant finished rolls is that the present invention produces a ceramic coating that consists substantially of a single metal oxide, titanium dioxide, and which coating has superior machining characteristics, that is, the coated roll is more easily machined to a very smooth surface than mixed metal oxide coatings. For example, the machine ground coated rollers of the present invention can typically possess a ceramic coating hardness in the range of about a "C" on the Rockwell hardness scale. The ceramic coated rollers can be finished to mirror surface smoothness with known grinding and polishing techniques, for example, diamond grinding. The surface smoothness of the finished coated rollers can be quantitatively characterized using known surface roughness measurement and characterization equipment. The finished rollers of the present invention can typically possess a surface smoothness or an arithmetic mean roughness (Ra) value of from about 0.3 to about 1.5 microns, and more preferably of from about 0.3 to about 0.7 microns. An unfinished roller will have a surface smoothness that will depend upon the quality controls of the plasma spray process and the smoothness is typically from about 2.5 to about 5.0 microns. The unfinished roll may not be entirely suitable for certain high precision electrophotographic development apparatus dimensions and performance specification requirements. The unfinished rollers may be disadvantaged by poor electrically charged toner release and concomitant compromised image quality and roller performance longevity.

The dielectric constant of the ceramic layer coating can, for example, range from about 15 to about 170 units, reference "*Modern Ceramic Engineering*" by Richardson, Marcel Dekker, Inc., (1992), from about 80 to about 175 for single crystal titania, reference "*Introduction to Ceramics,*" by Kingery, Wiley and Sons, (1976), and from about 20 to about 50 for titania films, reference "*Ceramic Materials for Electronics,*" by Buchanan, Marcel Dekker, Inc., (1986), for either or both the finished and unfinished rollers, based upon tabulated literature values, for high purity titanium dioxide films of comparable thicknesses. However, the present invention while not wanting to be limited by theory is believed, based on preliminary findings and theoretical considerations, to provide plasma derived titanium dioxide coatings with an unexpectedly elevated and or broadened dielectric constant ranges. Thus, the present invention can provide titanium dioxide coatings with dielectric constant ranges, for example, from about 50 to about 1,000, preferably from about 100 to about 1,000, and more preferably from about 500 to about 1,000 at 100 KHertz.

Although not wanting to be limited by theory, it is believed that the elevated dielectric range may be attributed, in whole or in part, to a unique particle morphology or particle packing that arises from the preparative process described in the present invention. The ceramic particles are melted in the plasma and propelled onto a substrate receiver surface. Upon striking the substrate surface the particles are believed to be flattened or splat cooled. The degree of spreading is a function of, for example, the particle's viscosity, kinetic energy, surface tension, and crystallization kinetics. For example, a 30 micron diameter plasma particle when deposited on the substrate can spread to form a thin platelet with a thickness of less than about one micron. The energy of the plasma not only melts the ceramic particle but also strips oxygen out of the crystal structure leaving the deposited layer reduced and semi-conductive. Subsequently, deposited particles melt and impinge upon the previously deposited particulate material thereby producing a structure believed to be comprised of a plurality of very thin layers or platelets. The resultant reduced titania coating is thereafter subjected to heating or firing in an oxygenated or oxygen rich atmosphere. This oxidative heating replaces some of the oxygen in the deposited particles that was previously expelled therefrom in the plasma spray operation. The diffusion rate of oxygen back into the ceramic coating monolith along the grain boundaries between the deposited ceramic particles is generally higher than the diffusion rate of oxygen into the bulk so that the platelet particle surfaces or grain boundaries are expected to be more highly oxidized and insulating compared to the platelet particle bulk. The result is a morphological structure that is believed to include a compounding or piling-up of a plurality of very thin alternating semiconductive and insulating layers. The plurality of alternating semi-conductive and insulating microscopic interfaces through the coating limits charge transfer and is believed to lead to high polarization thereby enhancing the capacitive properties of the coating.

The present invention provides, in embodiments, a process comprising:

depositing a titanium dioxide layer onto a substrate with plasma spray coating; and oxidatively heating the resulting titanium dioxide coated substrate.

The dielectric constant of the resulting coating can be, for example, from about 50 to about 1,000. The heating can be accomplished at a temperature of from about 550° C. to about 650° C., for a time, for example, of from about 3 to about 6 hours.

The present invention provides, in embodiments, a process comprising:

coating a titanium dioxide layer onto a substrate, such as a roll or a plate, with a plasma spray;

grinding the surface of the resulting titanium dioxide coating layer to a smooth finish; and firing the resulting ground titanium dioxide coated substrate.

The coating can be, for example, from about 50 to about 500 microns thick, and the thickness can be readily controlled by the spray operator and further refined by the grinding-finishing conditions. The smoothness or arithmetic mean roughness (Ra) value of the ground roll finish can be, for example, from about 0.3 to about 1.5 microns and can be accomplished with diamond grinding, and the firing can be accomplished, for example, at a temperature of from about 550° C. to about 650° C., and for time of from about 1 to about 10 hours, and preferably from about 3 to about 6 hours. The dielectric constant of the resulting coating can be, in preferred embodiments, from about 500 to about 1,000.

The coefficients of thermal expansion (CTE) of the core and of the resulting titanium dioxide coating are preferably substantially similar and the coefficients can be in the range of from about $10^{-5}$°C.$^{-1}$ to about $10^{-7}$°C.$^{-1}$. Although not desired to be limited by theory it is believed that the high temperatures used in the preparative coating process, for example, about 600° C., the coefficients of thermal expansion (CTE) should be the about the same or substantially similar. Substantial differences between in the respective coefficients of thermal expansion (CTE) are suspected as a causative aspect in ceramic coating failure, especially at temperatures of about 650° C. and above, for example, 700° C. and higher.

A requirement of the cylindrical roller core selected is that it be reasonably conductive. Examples of suitably conductive roller cores include: metals, metal alloys, high temperature or heat resistant plastics, fiber reinforced resins, composites, ceramics, ceramers, and the like materials, and mixtures thereof. Since the plasma-heating coating process of the present invention involves high temperatures and for sustained periods of time, the cylindrical roller core substrate preferably should be capable of withstanding the oxidative heat treatment process temperatures of about 600° C. and above and the roller core material should not oxidize or degrade to any appreciable extent.

The ceramic layer can cover the entire convex surface of the roller. In embodiments, it is desirable to provide coated rollers which are completely coated with the ceramic layer on the external surface of the roller. In other applications it is desirable to coat the entire outside roller surface except for all but about from 0.1 inch to about 1.0 inch from the ends of the roller, and which uncoated areas engage, for example, electrical and mechanical componentry to enable the developer housing operation.

In embodiments of the present invention there is provided a process for preparing a single metal oxide ceramic coated roller comprising: coating a cylindrical roller core with a plasma spray coating of titanium dioxide followed by oxidative heating of the resulting coated roller. In a preferred embodiment, the roller core is treated with either or both a bond coat and a intermediate transition coating prior to plasma spraying the titanium dioxide coating. In another preferred embodiment, the coated roller core, subsequent to plasma spray coating but prior to oxidative heating or firing, is mechanically ground to a smooth surface finish with grinding methods known to those of ordinary skill in the art, such as diamond grinding, to obtain a plasma coated titanium dioxide roller with a smoothness or arithmetic mean roughness (Ra) of the finish is from about 0.3 to about 1.5 microns. When the coating process is accomplished in accordance with the preferred embodiments, there is obtained rollers in higher overall yield, that is, there are fewer instances of coating failure, for example, along the edges of the coated rolls wherein there is observed high stress concentration areas, compared to coated products prepared without either or both the bond and intermediate coats, and without a grind step in between the plasma coating and oxidative heating or firing stages.

The reductive plasma spray coating can be accomplished in an atmosphere with various levels of oxygen present, for example, substantially free of oxygen, such as with an inert gas like nitrogen or argon present, with an oxygen partial pressure less than ambient air, with an oxygen partial pressure comparable to ambient air, or with an oxygen partial pressure greater than ambient air, while the subsequent oxidative heating can be accomplished at temperatures of from about 550° C. to about 650° C. for from about 3 to about 6 hours, and more preferably from about 575° C. to about 625° C. for from about 4 to about 5 hours. The oxidative heating stage can best be accomplished in an oxygen containing atmosphere, that is, exposing the resulting intermediate plasma coated roller to molecular oxygen for a time, for example, under ambient air or enriched oxygen atmosphere conditions. The partial pressure of oxygen in the oxidizing atmosphere can be comparable to, or greater than that of ambient air. The plasma coating stage and subsequent oxidation stage, either or both, can be repeated to apply successive ceramic layers to a single roller core if desired, for example, from about 1 to about 10 times, for example, to achieve a coating layer that is more uniform in thickness the plasma spray coating can be accomplished several times or in several passes while the piece is elevated coating temperature and before cooling. A typical plasma spray coating can produce a coating thickness, for example, form about 1 to about 40 micrometers, and preferably from about 5 to about 30 micrometers, and preferably from about 10 to about 20 micrometers in each successive pass. However, the successive plasma coating stage is preferably accomplished while coated roller is at elevated coating temperatures, and prior to cooling, otherwise the subsequent coatings at lower or room temperatures are likely to have poor adhesion properties and may delaminate in a subsequent heating cycle.

The present invention provides in embodiments a printing machine comprising:

a housing defining a chamber for storing a supply of toner particles therein;

a donor roll including a ceramic outer surface comprising, for example, a cylindrical roller core, and a titanium dioxide ceramic layer bonded to the exterior of the cylindrical roller core, the donor roll being mounted at least partially in the chamber of the housing and being adapted to advance toner particles to the latent image; and an electrode member positioned in the space between a latent image bearing member and the outer surface of the donor roll, the electrode member being closely spaced from the ceramic outer surface of the donor roll and being electrically biased to detach toner particles from the ceramic outer surface of the donor roll so as to form a toner powder cloud in the space between the electrode member and the latent image with detached toner particles from the toner cloud developing the latent image, wherein the outer surface of the donor roll has an acceptable discharge time constant. The ceramic outer surface of the donor roll can have a conductivity of from about $10^7$ to about $10^{10}$ ohm-cm, and more preferably from about $10^8$ to about $10^{10}$ ohm-cm.

The electrode member can include a plurality of wires spaced from one another, a transport roll mounted in the chamber of the housing and being positioned adjacent the ceramic outer surface of the donor roll, the transport roll being adapted to advance toner particles to the ceramic outer surface of the donor roll.

The printing machine of the present invention can further comprise applying an alternating electric field between the donor roll and the transport roll to assist in the transfer of at least a portion of toner particles from the transport roll to the ceramic outer surface of the donor roll, wherein the applied electrical field alternates at a selected frequency, for example, from between about 200 Hz and about 20 kHz with a voltage of from about 200 to about 400 Vrms.

In embodiments the electrode member can include a hybrid jumping development configuration, reference for example, U.S. Pat. No. 5,587,224, issued Dec. 24, 1996. Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development systems that can be selected. In jumping development, an AC voltage is applied to the donor roll for detaching toner from the donor roll and projecting the toner toward the photoconductive member so that the electrostatic fields associated with the latent image attract the toner to develop the latent image. Single component development systems appear to offer advantages in low cost and design simplicity. However, the achievement of high reliability and simple, economic manufacturability of the system continue to present problems. Two component development systems have been used extensively in many different types of printing machines. A two component development system usually employs a magnetic brush developer roller for transporting carrier having toner adhering triboelectrically thereto. The electrostatic fields associated with the latent image attract the toner from the carrier so as to develop the latent image. In high speed commercial printing machines, a two component development system may have lower operating costs than a single component development system. Clearly, two component development systems and single component development systems each have their own advantages. Accordingly, it is considered desirable to combine these systems to form a hybrid development system having the desirable features of each system. For example, at the 2nd International Congress on Advances in Non-Impact Printing held in Washington, D.C. on Nov. 4 to 8, 1984, sponsored by the Society for Photographic Scientists and Engineers, there was described a development system using a donor roll and a magnetic roller. The donor roll and magnetic roller were electrically biased. The magnetic roller transported a two component developer material to the nip defined by the donor roll and magnetic roller, and toner is attracted to the donor roll from the magnetic roll. The donor roll is rotated synchronously with the photoconductive drum with the gap there between being about 0.20 millimeter. The large difference in potential between the donor roll and latent image recorded on the photoconductive drum causes the toner to jump across the gap from the donor roll to the latent image and thereby develop the latent image.

According to the present invention, there is provided an apparatus for developing electrostatic latent images. A housing defines a chamber for storing a supply of toner particles therein. A donor roll, with a ceramic outer surface, is mounted at least partially in the chamber of the housing to advance toner particles to the latent image. An electrode member is positioned in the space between the latent image and the donor roll, closely spaced from the ceramic surface of the donor roll and electrically biased to detach toner particles therefrom so as to form a toner powder cloud in the space between the electrode member and the latent image with detached toner particles from the toner cloud developing the latent image. There is also provided an electrophotographic printing machine of the type having an electrostatic latent image recorded on a photoconductive member and a developer unit adapted to develop the latent image with developer material. The improved developer unit comprises a housing defining a chamber for storing a supply of developer material therein. The developer unit also comprises a donor roll, including a ceramic outer surface with a thickness ranging from about 75 to about 450 micrometers. The donor roll is mounted at least partially in the chamber of the housing and is adapted to advance developer material to the latent image. An electrode member is positioned in the space between the latent image and the ceramic outer surface of the donor roll. The electrode member is closely spaced from the donor roll and is electrically biased to detach developer material from the ceramic outer surface of the donor roll so as to form a powder cloud of developer material in the space between the electrode member and the latent image with detached developer material from the cloud of developer material developing the latent image. There is further provided an electrophotographic printing machine of the type which has an electrostatic latent image recorded on a photoconductive member and a two component developer unit adapted to develop the latent image with developer material. The improved developer unit includes a housing which defines a chamber for storing a supply of carrier granules having toner particles adhering triboelectrically thereto. The improved developer unit also comprises a transport roll mounted in the chamber of the housing for advancing carrier granules and toner particles therefrom. The improved developer unit further comprises a donor roll which includes a titanium dioxide ceramic coated outer surface. The donor roll is mounted at least partially in the chamber of the housing adjacent the transport roll to receive toner particles therefrom and is adapted to advance toner particles to the latent image. An electrode member is positioned in the space between the latent image and the titanium dioxide ceramic coated outer surface of the donor roll. The electrode member is closely spaced from the ceramic outer surface of the donor roll and is electrically biased to detach toner particles from the donor roll so as to form a toner powder cloud in the space between the electrode member and the latent image with detached toner particles from the toner cloud developing the latent image.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Titanium Dioxide Plasma Coated Roller Substrate

A suitable roller substrate or core was selected and constructed of 310 stainless steel which steel was chosen for its low thermal expansion properties and high resistance to oxidation in desired process temperature range of about 600° C. The roller's physical dimensions do not appear to be critical to formation of a satisfactory titanium dioxide ceramic layer since a variety of roller dimensions produced satisfactory coating in accordance with the present invention. Suitable alternative substrates include any other steels or materials which function similarly or better than the exemplary 310 stainless. Other suitable materials are metals, composites, ceramics, and the like materials, which can withstand elevated temperatures, minimize thermal expansion, and resist corrosion under high temperature oxygen/oxidizing environment.

Bond Coat

A chrome aluminum yttrium cobalt powder, commercially available from Praxair as CO-106-1, was plasma sprayed over a grit blasted steel substrate according to manufacturer recommended spray parameters accompanying the powder. This was followed by an optional plasma spray midcoat consisting of a 1:1 by volume mixture of chrome aluminum yttrium cobalt powder and titanium dioxide commercially available from Sulzer Metco as 102. Other commercially available bond coats are believed to be useful for either or both bond or mid-coating.

Single Component Ceramic Coating

Plasma spray coating of the $TiO_2$ ceramic layer was accomplished with Praxair Thermal Spray Equipment using a SG 100 torch. Plasma gases were: primary gas, argon, at 91 SCFH, and secondary gas, helium, at 35 SCFH. Carrier flow was also argon gas at 9 SCFH. The metal oxide was titanium dioxide, Sulzer Metco 102, with a mean particle size of about 35 microns. A power level of 35 kW sufficient to melt the powder was used and in accordance with the recommended parameters supplied with powders. Alternative plasma coating approaches can use other equipment, gases, and/or powder particle sizes, wherein parameters are adjusted accordingly to achieve the same or similar result. For example, High Velocity Oxy Fuel (HVOF) or other thermal spray processes are believed to be adaptable and satisfactory to achieving comparable and equivalent coating results.

Intermediate Finishing Operations

Parts were finished on a Weldon Grinder with a vitrified bonded diamond wheel. Grinding parameters tend to be highly dependent upon part and equipment geometry. Alternative finishing procedures can include, for example, superpolishing and centerless grinding.

Oxidizing Heat Treatment

Ambient air was used in a standard muffle furnace for the oxidizing heat treatment. The coated rollers were in the oven for about 4 to about 5 hours total with a slow temperature ramp up and down from room temperature, of about 8° C. per minute, to avoid thermal shock. The roller parts were held at a temperature of about 600° C. for about 3 hours. A minimum of three hours was necessary to achieve the desired electrical properties. Alternative oxidative processing can include controlling, for example increasing, the partial pressure of oxygen which change is believed can change other parameters accordingly and can be used to control or adjust the electrical and physical properties of the resultant coated rollers.

Conductivity Characterization

In a typical measurement of bulk material properties, a voltage of about 100 volts was applied to the coating through about a 2.5 square centimeter contact area. The current flowing through the bulk of the coating was recorded and after measuring the coating thickness the resistivity was calculated. A plot of resistivity versus nominal firing temperature used for many different experiments indicated that from about 25° C. to about 550° C. the resistivity increased essentially linearly, whereas in the range of from about 550° C. to about 650° C. the resistivity increased dramatically exponentially and was highly suggestive of an inflection point in the resistivity versus firing temperature curve. At temperatures above about 650° C., for example, at about 700° C., the resistivity was apparently leveling off. However, there was observed a noticeable decline in yield or increase in coating material losses at higher temperatures, for examples, at 700° C. there was observed a 50% loss, and at 900° C. and 1,000° C. there was observed a complete loss or no $TiO_2$ coating material remained on the roller core. Titanium dioxide coatings with dielectric constant ranges, for example, from about 50 to about 1,000, at 100 KHertz could be prepared in accordance with the present invention.

Other modifications of the present invention may occur to one of ordinary skill in the art based upon a review of the present application and these modifications, including equivalents thereof, are intended to be included within the scope of the present invention.

What is claimed is:

1. An article comprising:

an electrically conductive roller core; and a ceramic layer bonded to the core consisting of a single component titanium material, wherein the titanium material of the ceramic layer has a plurality of layered thin platelet particles which particles have surfaces which are electrically insulative and particle interiors which are electrically conductive.

2. The article in accordance with claim 1, wherein the ceramic layer is bonded to the exterior surface of the roller core.

3. The article in accordance with claim 1, wherein the article is electrostatically chargeable.

4. The article in accordance with claim 1, wherein the dielectric constant of the ceramic layer is from about 50 to about 1,000 units.

5. The article in accordance with claim 1, wherein the resistivity of the article is from about $10^{-3}$ to about $10^{10}$ ohm-cm.

6. The article in accordance with claim 1, wherein the resistivity of the article is from about $10^{7}$ to about $10^{10}$ ohm-cm.

7. The article in accordance with claim 1, wherein the thickness of the ceramic layer is from about 75 to about 450 micrometers.

8. The article in accordance with claim 1, wherein the hardness of the ceramic layer is about in the "C" range on the Rockwell hardness scale.

9. The article in accordance with claim 1, wherein the roller core is selected from the group consisting of metal, metal alloys, high temperature resistant plastics, fiber reinforced resins, composites, ceramics, ceramers, and mixtures thereof.

10. A process for preparing the article of claim 1, comprising coating the roller core with a plasma spray coating of titanium dioxide followed by oxidative heating of the resulting coated roller at a temperature of from about 550° C. to about 650° C., for from about 3 to about 6 hours, wherein the coefficient of thermal expansion (CTE) of the core and of the resulting titanium dioxide coating are substantially similar and wherein the coefficient is in the range of from about $10^{-5}$° C.$^{-1}$ to about $10^{-7}$° C.$^{-1}$.

11. The process in accordance with claim 10, wherein the plasma spray coating is accomplished in an atmosphere of ambient air.

12. The process in accordance with claim 10, wherein the oxidative heating is accomplished at a temperature of from about 550° C. to about 650° C., for from about 3 to about 6 hours.

13. The process in accordance with claim 10, wherein the oxidative heating is accomplished in an oxygen containing atmosphere.

14. The process in accordance with claim 10, further comprising finishing the coated roller to mirror surface smoothness with diamond grinding prior to heating.

15. The process in accordance with claim 14, wherein the surface of the resulting finished roller has a smoothness or an arithmetic mean roughness (Ra) value of from about 0.3 to about 1.5 microns.

16. The process in accordance with claim 10, further comprising applying an overcoat to the surface of the coated roller selected from the group consisting of waxes, polymeric resins, metal oxides or mixed metal oxides, hydrophobic metal oxides or mixed hydrophobic metal oxides, and mixtures thereof.

17. The process in accordance with claim 10, further comprising applying either or both a bond coat and an intermediate transition coating to the roller core prior to plasma spraying the titanium dioxide coating.

18. An article in accordance with claim 1, wherein the platelet particles have a thickness of less than about one micron.

19. An article in accordance with claim 18, wherein the surface of the individual platelet particles are oxidized and are electrically insulative whereas the bulk of individual platelet particles are reduced and electrically semiconductive compared to the platelet surface.

20. A printing machine comprising:

a housing defining a chamber for storing a supply of toner particles therein;

a donor roll article comprising an electrically conductive roller core; and a ceramic layer bonded to the core consisting of a single component titanium material, wherein the titanium material of the ceramic layer has a plurality of layered thin platelet particles which particles have surfaces which are electrically insulative and particle interiors which are electrically conductive, the donor roll being mounted at least partially in the chamber of the housing and being adapted to advance toner particles from the chamber to a latent image residing on an image bearing member; and an electrode member positioned between the latent image bearing member and the outer surface of the donor roll article, the electrode member being closely spaced from the outer surface of the donor roll and being electrically biased to detach toner particles from the outer surface of the donor roll so as to form a toner powder cloud in the space between the electrode member and the latent image with detached toner particles from the toner powder cloud thereby developing the latent image.

21. A printing machine in accordance with claim 20, wherein the electrode member includes a plurality of wires spaced from one another, a transport roll mounted in the chamber of the housing and being positioned adjacent the outer surface of the donor roll, the transport roll being adapted to advance toner particles to the outer surface of the donor roll.

22. A printing machine in accordance with claim 21, further comprising applying an alternating electric field between the donor roll and the transport roll to assist in transferring at least a portion of toner particles from the transport roll to the outer surface of the donor roll, wherein the applied electrical field alternates at a selected frequency ranging between about 200 Hz and about 20 kHz with a voltage of from about 200 to about 400 Vrms.

* * * * *